US007143931B2

(12) United States Patent
Johnson

(10) Patent No.: US 7,143,931 B2
(45) **Date of Patent: *Dec. 5, 2006**

(54) CONTAINER FOR FOODSTUFFS

(75) Inventor: Terry J. Johnson, Chicago, IL (US)

(73) Assignee: Gamon Plus, Inc., Elk Grove Village, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/988,119

(22) Filed: Nov. 12, 2004

(65) Prior Publication Data

US 2005/0061860 A1 Mar. 24, 2005

Related U.S. Application Data

(63) Continuation-in-part of application No. 10/623,829, filed on Jul. 21, 2003.

(51) Int. Cl.
*B65D 5/46* (2006.01)
*B65D 25/04* (2006.01)

(52) U.S. Cl. ..... 229/117.14; 229/120.011; 229/120.16; 229/122; 229/161; 229/902; 229/913

(58) Field of Classification Search ..... 229/117.14, 229/117.22, 122, 161, 902, 906, 913, 120.16, 229/120.011; 206/557; 426/115
See application file for complete search history.

(56) References Cited

U.S. PATENT DOCUMENTS 2,661,142 A * 12/1953 Hendrickson, Jr. ..... 229/117.14
2,685,402 A * 8/1954 Caster ..... 229/117.14
2,749,019 A * 6/1956 Ohlund ..... 229/122
2,983,429 A * 5/1961 Bergstein ..... 229/117.13
3,018,032 A * 1/1962 Butterfill ..... 229/117.14
3,114,474 A * 12/1963 Davis ..... 229/120.012
3,291,368 A * 12/1966 Hess ..... 229/136
3,317,326 A * 5/1967 Peters ..... 229/122
3,587,836 A * 6/1971 Brown ..... 229/117.14
3,703,256 A * 11/1972 Ross ..... 229/122
3,759,720 A * 9/1973 Young ..... 229/122
3,788,876 A * 1/1974 Baker et al. ..... 229/132
3,790,066 A * 2/1974 Malinowski ..... 229/122
3,981,397 A 9/1976 Arneson
4,144,966 A 3/1979 Kulig
4,308,995 A 1/1982 Hanes
4,511,042 A * 4/1985 Wischusen, III ..... 229/122
4,696,402 A * 9/1987 Harmon et al. ..... 229/120.011
4,844,330 A 7/1989 Roosa et al.
5,039,003 A 8/1991 Gordon et al.
5,180,075 A * 1/1993 Montalbano ..... 229/122
5,476,215 A 12/1995 Baroud
5,518,169 A 5/1996 Beales
5,655,707 A 8/1997 Jensen
6,227,441 B1 * 5/2001 Sagel et al. ..... 229/120.011

* cited by examiner

*Primary Examiner*—Gary E. Elkins
(74) *Attorney, Agent, or Firm*—Vedder Price Kaufman & Kammholz, P.C.

(57) ABSTRACT

A container for foodstuffs including a carton and pad, each formed from a cut and creased blank of foldable sheet material. The carton is a substantially tubular element having end panels for enclosing the carton. A plurality of corner locks are provided to maintain the end panels oriented in a closed position. A lip is connected to one side panel and has a free edge disposed adjacent a top panel to provide support therefor. Handles formed in the carton permit stacking of the containers and easy transportation.

16 Claims, 6 Drawing Sheets

CONTAINER FOR FOODSTUFFS

This application is a continuation-in-part of U.S. application Ser. No. 10/623,829, entitled "Container For Foodstuffs", filed Jul. 21, 2003.

BACKGROUND OF THE INVENTION

The present invention relates to a container, and more particularly, to a paperboard container including a carton, among other things, fashioned from unitary blank of paperboard.

The carton, in a set-up condition, has a generally tubular shape and has moveable handles defined in the walls thereof. While the container art includes many different constructions, in general, none of them exhibits the advantage of the present invention for the specific purpose of a container for foodstuffs.

Prior art containers suitable for carrying elongated foodstuffs commonly include a handle for carrying configured as a vertically extending fin or tent-like structure. Such a handle commonly extends along the length of the container and substantially along a longitudinal axis thereof. In particular, U.S. Pat. Nos. 1,984,611, issued to Weaver; U.S. Pat. No. 2,074,638, issued to Black; and U.S. Pat. No. 5,655,707, issued to Jensen, all disclose such containers. However, there is a major disadvantage associated with these containers. Stacking of the assembled containers for use either before or after receipt of contents is nearly impossible. As a result, increased amounts of storage area is required. This, of course, increases costs to the user.

Therefore, there is a significant demand for a container for foodstuffs which is easy to manufacture from less raw materials, compact for shipping, easy to assemble for receiving contents, stackable, durable and having lockable end flaps for retaining the contents therein during transport which provides the advantages of low cost, high strength, stackability, ease of use, economized footprint and space requirements while increasing functionality.

BRIEF DESCRIPTION OF THE DRAWINGS

In the course of the following detailed description, reference will be made to the attached drawings, wherein like reference numerals identify like parts and in which.

DETAILED DESCRIPTION OF THE PREFERRED EMBODIMENTS OF THE INVENTION

Figure 1:
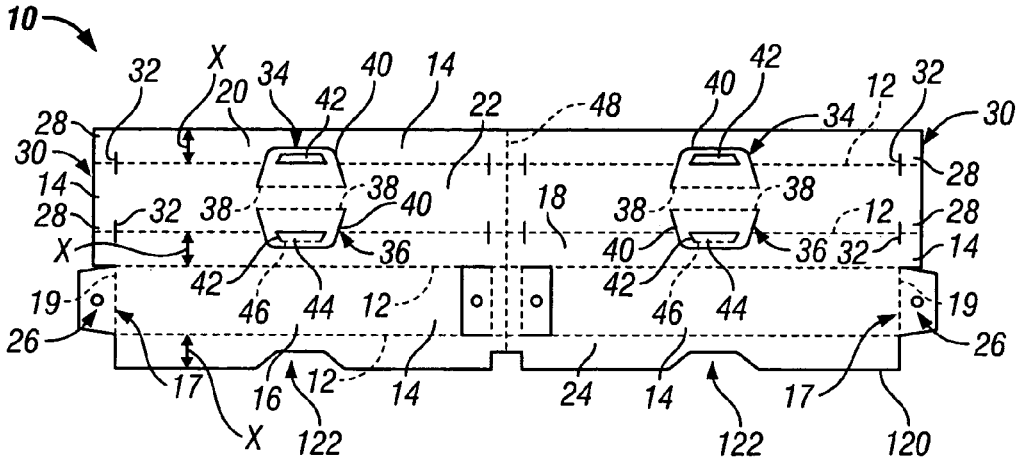
FIG. 1 is a plan view of a unitary blank of paperboard or other stiff foldable and resilient sheet material from which a carton of this invention is constructed.
Figure 2:
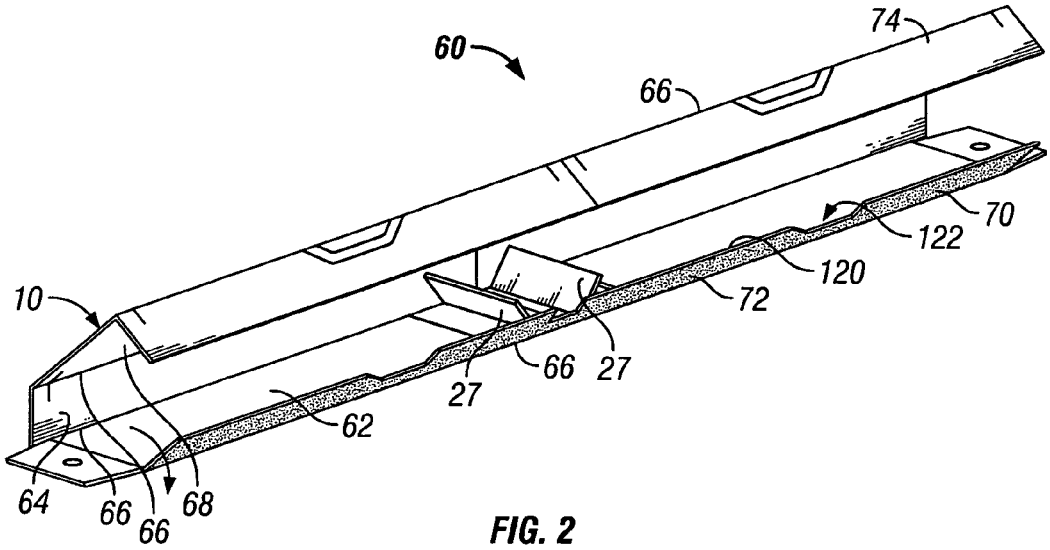
FIG. 2 is an assembly drawing of the blank of FIG. 1 illustrating a first step for assembly of the blank into a carton.

One principal aspect of the present invention is directed to a blank for fabricating a carton, which is formed from a generally rectangular sheet of material. The blank is divided by a plurality of longitudinal fold-forming creases into a plurality of generally rectangular sections which sections are laterally offset relative to one another. Each of the blank sections is divided by the longitudinal fold-forming creases into a base-forming panel hinged to one of a pair of opposing side-forming panels which flank a top-forming panel and to a lip-forming panel. The base-forming panel includes a pair of opposing end-forming panels hinged to the base-forming panel by fold-forming creases for movement relative to the base-forming panel. The lip-forming panel and opposing side-forming panels each have an approximately equivalent lateral extent. A plurality of corner lock-forming portions are each defined in cooperatively adjacent top-forming panels and side-forming panels adjacent an end of the blank by a transverse cut line intersecting the longitudinal fold-forming crease and extending between adjacent top-forming and side-forming panels. A pair of opposed handle-forming portions are each defined in cooperatively adjacent top-forming and side-forming panels by a fold-forming crease disposed in the top-forming panel parallel to and offset from the longitudinal fold-forming creases and a cut line connecting opposed ends of the handle fold-forming crease.

In one embodiment, an aperture is defined in each handle-forming portion to facilitate carrying. In another embodiment, one of the handle-forming portions includes a locking flap defined therein by a cut line and hinged to the handle-forming portion by a fold-forming crease such that movement of the locking flap into engagement with an aperture defined in another handle-forming portion connects the handle-forming portions to facilitate carrying. In yet another embodiment, the blank is transversely bisected by a segmented cut line normal to each longitudinal fold-forming crease. In still another embodiment, the end-forming panels move rotationally in the same direction. In still yet another embodiment, the end-forming panels move rotationally in opposite directions. Finally, in another embodiment, the lip-forming panel further includes a recessed portion laterally aligned with each of the pair of opposed handle-forming portions.

Another principal aspect of the present invention is directed to a carton formed from a cut and creased blank of foldable sheet material. The carton includes, in a set-up condition, a base panel hinged at opposed longitudinal edges to a lip and one of a pair of opposing side panels which flank a top panel. The side panel hinged to the top panel remote from the base panel overlaps and connects to the lip, such that a free edge of the lip is disposed immediately adjacent the top panel, to define a tubular element. The base panel further includes a pair of opposing end panels each hinged to the base panel and movable from a first operative position to a second operative position. A plurality of corner locks are each defined by transverse cut line adjacent the end panels extending across a longitudinal edge between the top and side panels, such that each corner lock may be inversely disposed relative to the top and side panels to which the respective corner lock is connected in order to orient each adjacent end panel in the second operative position. The carton also includes a pair of opposing handles movable from a first operative position for stacking to a second operative position for carrying.

In one embodiment, the handles include a lock configured as a flap in one of the handles for engaging an aperture defined in the opposing handle. In another embodiment, one end panel extends from a first end of the base panel and another end panel is defined within the base panel having a hinge line adjacent a second end of the base panel such that the end panels move rotationally in the same direction from the first operative position to the second operative position. In yet another embodiment, the one end panel extends from a first end of the base panel and another end panel extends from a second end of the base panel, such that the end panels move rotationally in opposite directions from the first operative position to the second operative position. Finally, in another embodiment, the lip further includes a recessed portion in registration with an opening defined when the handles are disposed in the second operative position.

A further principal aspect of the present invention is directed to a container for foodstuffs. A carton is formed from a cut and creased blank of foldable sheet material. The carton includes, in a set-up condition, a base panel hinged at opposed longitudinal edges to a lip and one of a pair of opposing side panels which flank a top panel such that the side panel hinged to the top panel remote from the base panel and overlaps and connects to the lip panel, such that a free edge of the lip is disposed immediately adjacent the top panel, to define the tubular element. The base panel further includes a pair of opposing end panels, each hinged to the base panel and movable from a first operative position to a second operative position. A plurality of corner locks are each defined by a transverse cut line adjacent the end panels extending across a longitudinal edge between adjacent top and side panels such that each corner lock may be inversely disposed relative to the top and side panels to which the respective corner lock is connected in order to orient such adjacent end panel in the second operative position. A pair of opposing handles are movable from a first operative position for stacking to a second operative position for carrying. The container further includes a tray formed from a cut and creased blank of foldable sheet material including a base panel and opposing side panels hinged to the base panel by laterally spaced longitudinal edges. The container still further includes a pad formed from a cut and creased blank of foldable sheet material including a base panel and opposing end panels hinged to the base panel by longitudinally spaced lateral edges.

In one embodiment the carton, tray and pad are transversely bisected a segmented cut line normal to each longitudinal edge such as the container may be separated into like first and second containers. In another embodiment, the first and second containers each include one end panel extending from a first end of the base panel and another end panel defined within the base panel having a hinge line adjacent a second end of the base panel such that the end panels move rotationally in the same direction from the first operative position to the second operative position. Finally, in another embodiment, the lip further includes a recessed portion in registration with an opening defined when the handles are disposed in the second operative position.

Figure 7:
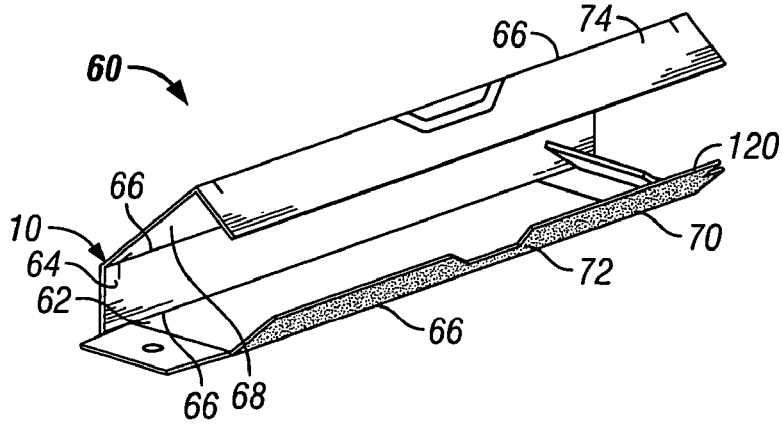
FIG. 7 is an assembly drawing of the blank of FIG. 6 illustrating a first step for assembly of the blank into a carton.

Referring now to FIGS. 1 and 7, the unitary blank of paperboard or other stiff, foldable and resilient sheet material from which each embodiment of the carton of the present invention may be formed is indicated generally by reference numeral 10. The blank 10 is useful for fabricating a carton and is formed from a generally rectangular sheet of material. The blank is divided by a plurality of longitudinal fold-forming creases 12 into a plurality of generally rectangular sections 14. In this embodiment, there are at least five generally rectangular sections. However, it will be recognized that any number of rectangular sections may be formed as desired. The sections 14 are laterally offset relative to each other.

The laterally offset blank sections 14 are generally configured as a base-forming panel 16 hinged to one of a pair of opposing side-forming panels 18, 20 which flank a top-forming panel 22. The base-forming panel 16 is hinged at an opposing side to a lip-forming panel 24. The lip-forming panel 24 and opposing side panels 18, 20 each have an approximately equivalent extent indicated by dimension X. The base-forming panel 16 in the embodiment shown in FIG. 1 includes a pair of opposing end-forming panels 26 hinged to the base-forming panel 16 at respective first and second ends 17 of the base-forming panel 16 by fold-forming creases 19 for movement relative to the base-forming panel 16. In the embodiment shown in FIG. 7, the base-forming panel 16 includes a pair of opposing end-forming panels 26, 27, wherein one of the end-forming panels 27 is defined within the base-forming panel 16. It will be recognized that the end-forming panels 27 are present in the embodiment of FIG. 1. However, they are not used in such embodiment.

A plurality of corner lock-forming portions 28 are each defined in cooperatively adjacent top-forming panel 22 and side-forming panels 18, 20 adjacent an end 30 of the blank by a transverse cut line 32 intersecting the longitudinal fold-forming creases 12 between adjacent top-forming panel 22 and side-forming panels 18, 20.

A pair of opposed handle-forming portions 34, 36 are each defined in cooperatively adjacent top-forming panel 22 and side-forming panels 18, 20 by parallel fold-forming creases 38, disposed in the top-forming panel 22 that are offset from the longitudinal fold-forming creases 12. A cut line 40, connects the opposed ends of the handle fold-forming creases 38. The cut line 40 is disposed partly in the top-forming panel 22 and the side-forming panels 18, 20. A handle aperture 42 is defined within the cut line 40 of each handle-forming portion 34, 36 substantially in the side-forming panels 18. One of the handle-forming portions 34, 36 includes a locking flap 44 hinged to the handle-forming portion 34, 36 by a fold-forming crease 46. Preferably, the fold-forming crease 46 is disposed in one of the side-forming panels 18, 20.

In one embodiment of the present invention, the blank 10 is transversely bisected by a segmented cut line 48 normal to each longitudinal fold-forming crease 12. As will be discussed below, the carton formed having the transverse segmented cut line 48 enables a user to separate the carton illustrated in FIGS. 1–6 into a plurality of cartons as illustrated in FIGS. 7–13 each having identical structure. Thus, the embodiment illustrated in FIG. 1 is useful as a double length carton as illustrated or as a plurality of cartons constructed in accordance with the embodiment of FIGS.

7–13. This invention is particularly useful in the made-to-order and carry-out sandwich industry where sandwiches are commonly available in six (6) foot and three (3) foot lengths. The embodiment shown in FIG. 1 preferably accommodates a six (6) foot sandwich or two three (3) foot sandwiches. After separating the container shown in FIG. 1 along the cut line 48, each container is identical as shown in FIG. 7, which can each accommodate a three (3) foot sandwich. One particular embodiment for manufacturing a container for a six (6) foot sandwich has an end-to-end dimension of seventy-seven (77) inches and a height or lateral extent dimension X of _____ inches. It will be recognized by those of skill in the art that changes in dimensions may be made as desired and still practice the present invention.

In the embodiment illustrated in FIG. 1, the end-forming panels 26 move toward one another or rotationally in opposite directions. However, the end-forming panels 26, 27 of the embodiment illustrated in FIG. 7, move rotationally in the same direction. It will be noted that in the embodiment illustrated in FIG. 7, one of the end-forming panels 27 is defined within the base-forming panel 16 by a cut line 50 and a fold-forming crease 52 which is offset from the end 30.

Referring now to FIGS. 2–6 and 8–13, assembly of the blank 10 into a carton and the container is described. A carton 60 may be formed from a cut and creased blank 10 of foldable sheet material in any conventional manner. Preferably, the carton 60 is partially assembled in a flat configuration for convenience in shipping. Creases 66 are formed in the blank such that the blank may be folded substantially in half about one of the creases 66 to form a two-layered element. Adhesive 72 is preferably applied to an outer surface of the lip 70 such that when the other side panel 74 is moved about another longitudinal crease 66, it is adhered to the adhesive 72 disposed on the lip 70. Upon completion of this step, a free edge 120 of the lip 70 is disposed immediately adjacent the inner surface of the top panel 68. This configuration is very important in that a significant reduction of raw materials necessary to construct the carton is realized in comparison to the prior art. However, strength of the carton has not been compromised. Specifically, co-pending application Ser. No. 10/632,829 uses a separate U-shaped tray which is received within the carton for strengthen or reinforcement purposes that is no longer needed in the present invention. At the point-of-use, the top and bottom layers may be moved in opposite directions to erect the carton 60.

As a result, the blank 10 may be assembled to define a tubular element seen in FIGS. 3–6 and 9–13. In the embodiment illustrated in FIG. 2, the end panels 27, disposed within the base panel 62 are moved from a first operative position coplanar with the base panel 62 merely to illustrate the position of each within the carton 60 of this embodiment. The end panels 27 in this embodiment are not used. In operation, the end panels 27 shown in the central portion of the base panel 62 would remain disposed coplanar with the base panel 62 unless the carton 60 illustrated in FIG. 2 were to be separated into two cartons each identically configured as illustrated in the embodiment shown in FIGS. 8–13. In which case, the end panels 27 would be used as discussed below.

Figure 3:
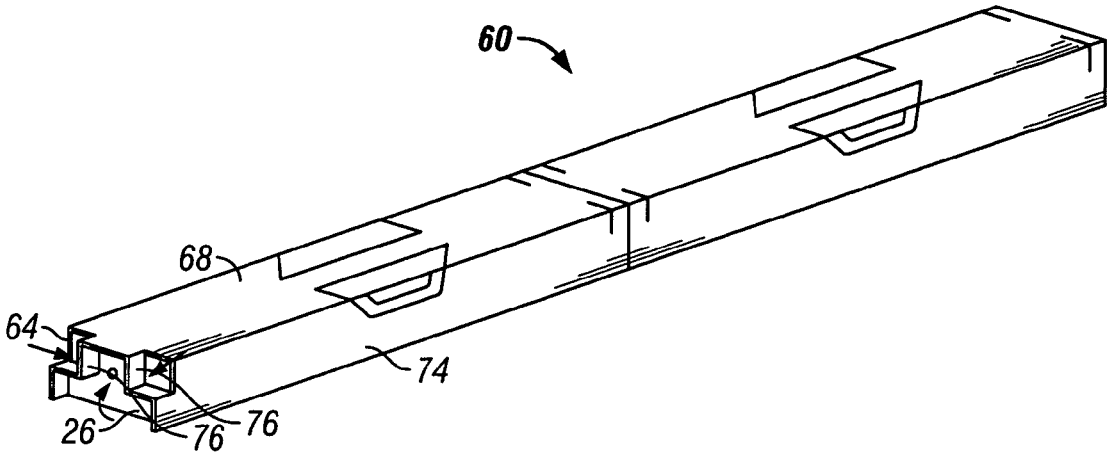
FIG. 3 is a perspective view of the carton formed from the blank of FIG. 1 illustrating a first end panel locked in position.
Figure 8:
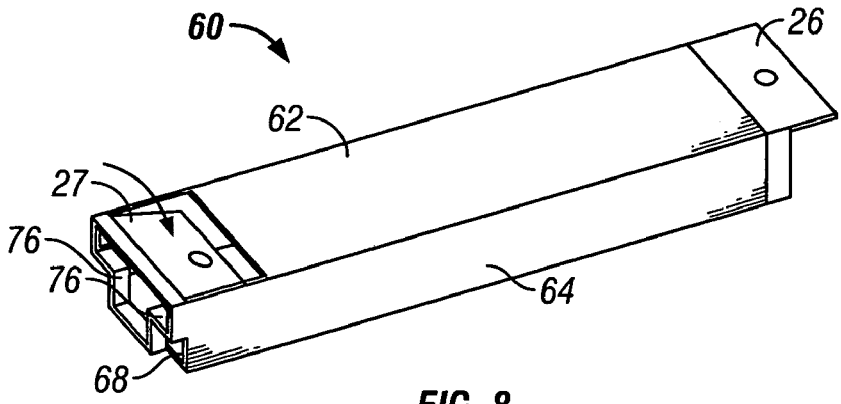
FIG. 8 is a bottom perspective view of a carton assembled from the blank of FIG. 6 illustrating one end panel being moved to a locked position from a bottom of the carton.
Figure 9:
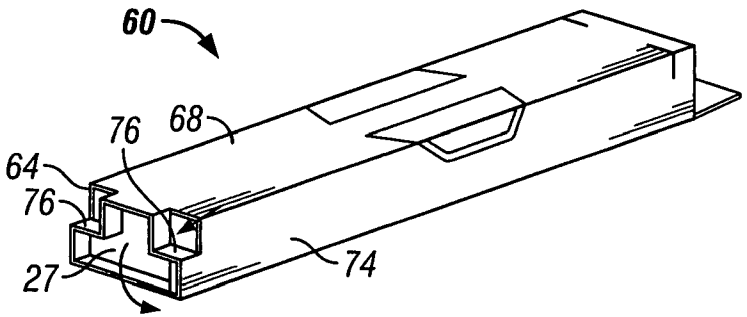
FIG. 9 is a top perspective view of the carton of FIG. 8 illustrating the end panel locked in position.

Referring now to FIGS. 3, 8 and 9, one of the end panels 26 (in FIG. 3), 27 (in FIG. 8) is moved from a first operative position substantially coplanar with the base panel 62 to a second operative position disposed substantially normal to the base panel 62. In the embodiment illustrated in FIG. 3, one of the end panels 26 is moved toward the opposing end panel. However, in the embodiment illustrated in FIG. 8, the end panel 27 is moved away from the opposing end panel 26 or in the same direction rotationally as the opposing end panel 26 will be moved in a subsequent step. It will be recognized that this is a result of end panel 27 being formed within the base panel 62. In both embodiments shown in FIGS. 3 and 8, the end panels 26, 27 moved to the second operative position are disposed to form one end of the carton 60. In order to maintain the end panel 26, 27 oriented in the second operative position, each of the corner locks 76 is inversely disposed relative to the top and side panels 68 and 64, 74 in which the corner lock 76 is defined.

Figure 5:
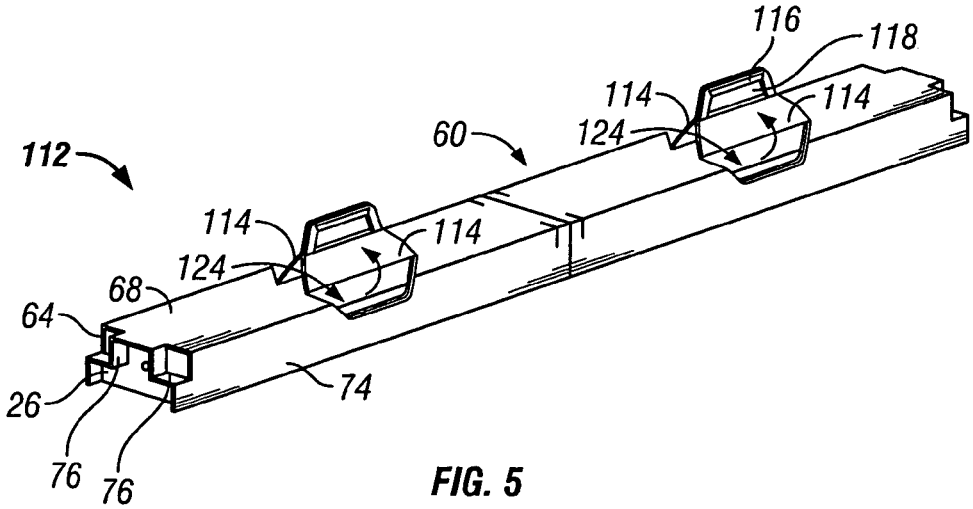
FIG. 5 is a perspective view of a container for foodstuffs constructed in accordance with the principles of the present invention.
Figure 4:
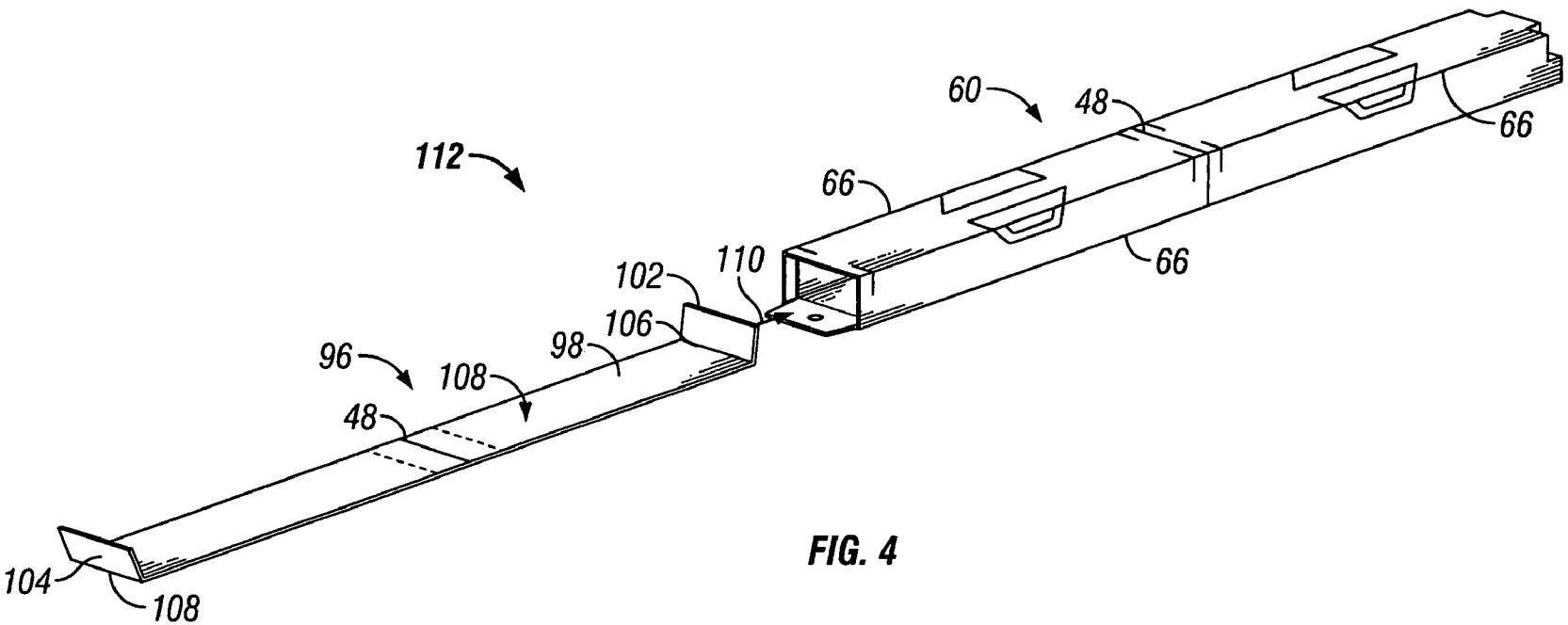
FIG. 4 is a perspective view of a pad being assembled and inserted into the carton of FIG. 3.
Figure 6:
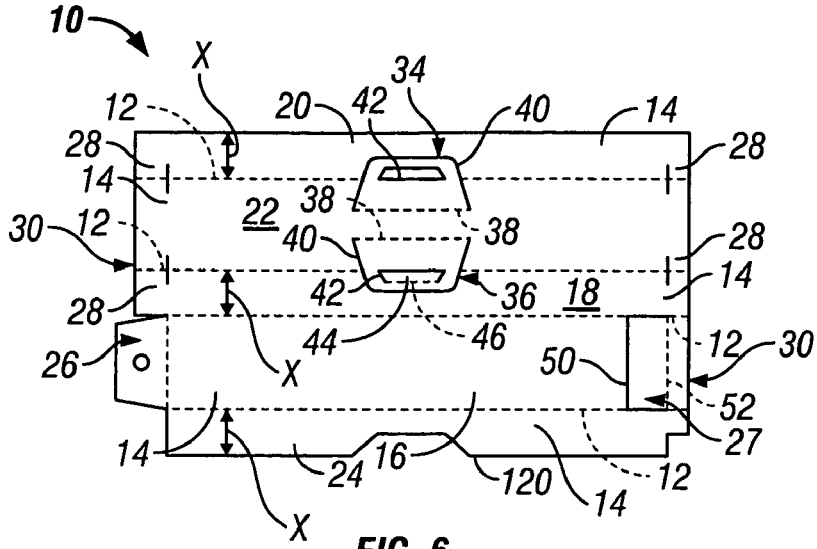
FIG. 6 is a plan view of a unitary blank of paperboard or other stiff, foldable and resilient sheet material from which one embodiment of the carton of the present invention is constructed.
Figure 10:
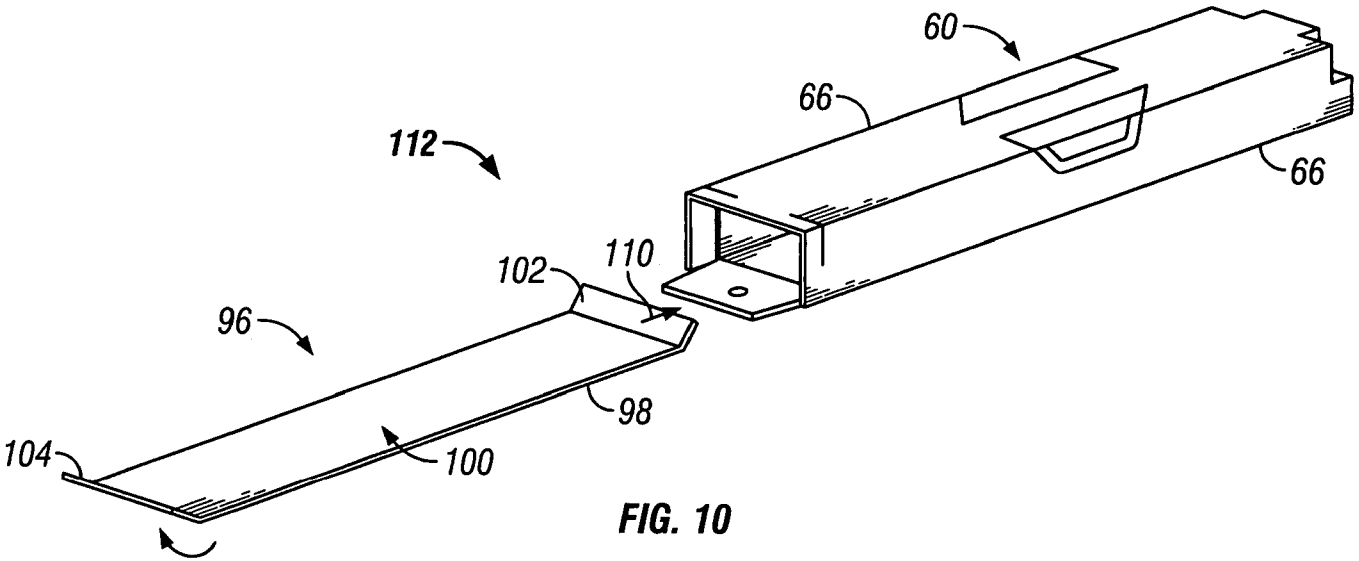
FIG. 10 is a perspective view of a pad being assembled and inserted into the carton FIG. 9.

Referring now to FIGS. 4 and 10, a pad 96 is formed from a cut and creased blank of foldable sheet material 98 including a base panel 100 and opposing end panels 102, 104 which are hinged to the base panel at longitudinal spaced lateral edges 106, 108. It will be recognized that pad 96 has a width configured such that the pad 96 may be received within the tray when moved in the direction of, arrow 110 to an installed position. It will be noted that the carton 60, tray 78, and pad 96, as illustrated in FIG. 5, are transversely bisected by a segmented cut line 48 normal to each longitudinal edge 66 such that the container 112 may be separated into identically configured containers of smaller dimensions. It will be recognized that the smaller containers are described in detail herein with respect to FIGS. 6–12, and that the containers 112 illustrated in FIGS. 10–12 may be formed independent of the container illustrated in FIG. 4 based upon the dimensions of the foodstuffs to be received within such container.

Figure 11:
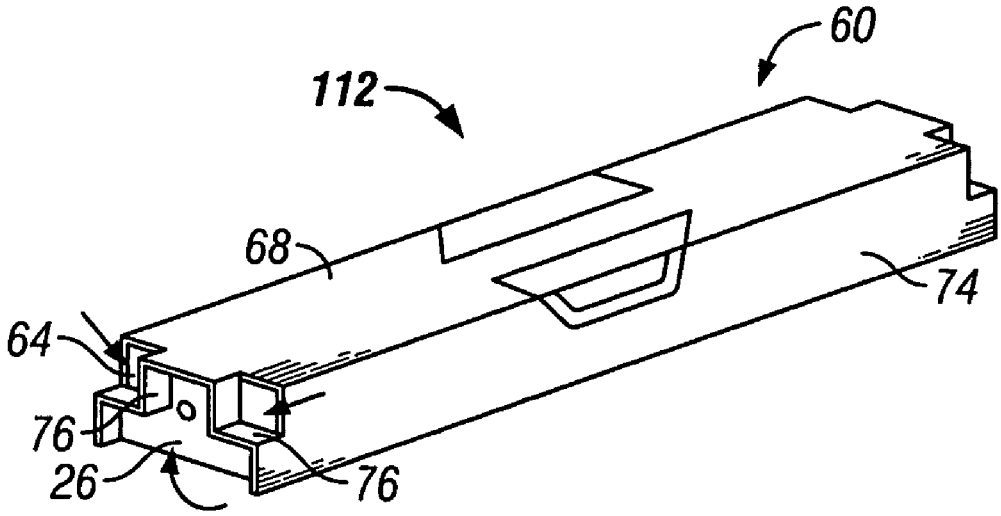
FIG. 11 is a perspective view of another end panel of the carton of FIG. 10 being locked into position.
Figure 12:
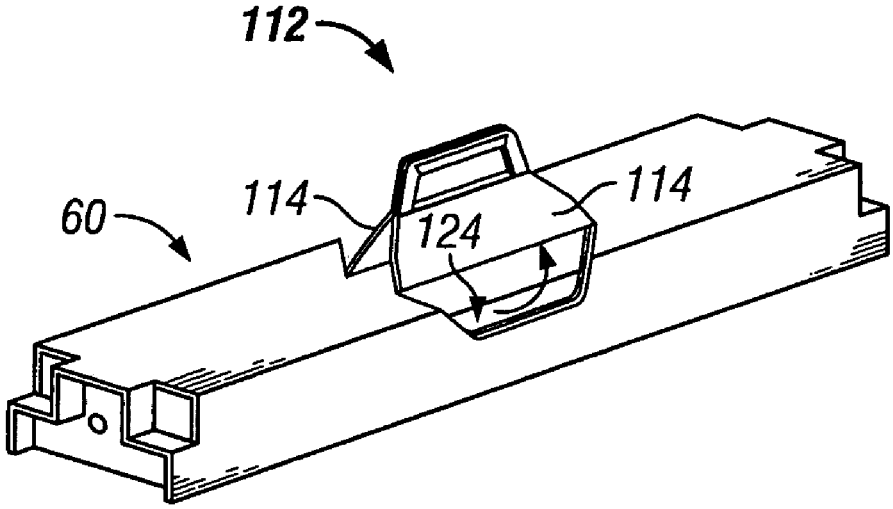
FIG. 12 is a perspective view of the carton of FIG. 11 illustrating the handles being moved into an operative position.

Referring now to FIGS. 5, 11 and 12, the container 112 including the carton 60, tray (not shown) and pad (not shown) can be fully enclosed by moving the second end panel 26 from the first operative position substantially coplanar with the base panel 82 to the second operation position. The second end panel 26 may be retained in the second operative position by inversely disposing each corner lock 76 relative to the top panel 68 and side panel 64, 74, as discussed above. In this configuration, the container, including enclosed foodstuffs is easily capable of stacking because of the flat top panel 68. It will be recognized that empty containers may also be stacked and ready to receive foodstuffs.

When the containers are ready for transport, the handles 114 are moved from the first operative position for stacking where the handles 114 are coplanar with portions of the top and side panels 68, 64, 67 to a second operative position for carrying where the handles 114 are moved about the longitudinal fold lines disposed offset from the longitudinal edges which define the top panel 68 to a substantially upright orientation, as shown in FIGS. 5 and 12. Such movement from one side panel is facilitated by a recessed portion 122 formed in the lip panel 72 from the free edge 120. The recessed portion 122 enables one of the handles 114 to be moved such that the movement reveals an opening 124 with which the recessed portion 122 is in registration. Preferably, one of the handles 114 includes a lock configured as a flap 116, which is configured to engage a handle aperture defined in the opposing handle 114. When the handles 114 are disposed in the second operative position, the container 112 may be easily carried and transported.

It will be recognized that as used herein, directional references such as "top", "base", "end", and "side" do not limit the respective panels to such orientation, but merely serve to distinguish these panels from one another. Any reference to hinged connection should not be construed as necessarily referring to a single fold line only; indeed it is envisaged that hinged connected can be formed from one or more of one of the following, a score line, a frangible line, a fold line segmented cut line or a perforated line, without departing from the scope of invention. The shape of the blank minimizes the amount of paperboard required for the carton.

While the preferred embodiments of the invention have been shown and described, it will be apparent to those skilled in the art that changes and modifications may be made therein without departing from the spirit of the invention, the scope of which is defined by the appended claims. For example, different materials, dimensions and methods of construction may be used.

What is claimed is:

1. A blank for fabricating a carton which is formed from a generally rectangular sheet of material comprising:

the blank divided by a plurality of longitudinal fold-forming creases into a plurality of generally rectangular sections, which sections are laterally offset relative to one another;

the blank sections generally configured as a base-forming panel hinged to one of a pair of opposing side-forming panels which flank a top-forming panel and to a lip-forming panel;

the base-forming panel including a pair of opposing end-forming panels hinged to the base-forming panel by fold-forming creases for movement relative to the base-forming panel;

the lip-forming panel and opposing side-forming panels each having an approximately equivalent lateral extent;

a plurality of corner lock-forming portions, each defined in cooperatively adjacent the top-forming panel and the side-forming panels adjacent an end of the blank by a transverse cut line intersecting the longitudinal fold-forming crease between the top-forming panel and an adjacent side-forming panel and extending between adjacent the top-forming panel and the side-forming panels; and a pair of opposed handle-forming portions, each defined in cooperatively adjacent the top-forming panel and the side-forming panels by a fold-forming crease disposed in the top-forming panel parallel to and offset from the longitudinal fold-forming creases and a cut line connecting opposed ends of the handle fold-forming crease.

2. The blank as defined in claim 1, wherein an aperture is defined in each handle-forming portion to facilitate carrying.

3. The blank as defined in claim 1, wherein one of the handle-forming portions includes a locking flap defined therein by a cut line and hinged to the handle-forming portion by a fold-forming crease such that movement of the locking flap into engagement with an aperture defined in another handle-forming portion connects the handle-forming portions to facilitate carrying.

4. The blank as defined in claim 1, wherein the blank is transversely bisected by a segmented cut line normal to each longitudinal fold-forming crease.

5. The blank as defined in claim 1, wherein the end-forming panels move rotationally in the same direction.

6. The blank as defined in claim 1, wherein the end-forming panels move rotationally in opposite directions.

7. The blank as defined in claim 1, wherein the lip-forming panel further includes a recessed portion laterally aligned with each of the pair of opposed handle-forming portions.

8. A carton formed from a cut and creased blank of foldable sheet material, which carton comprises, in set-up condition:

a base panel hinged at opposed longitudinal edges to a lip and one of a pair of opposing side panels which flank a top panel such that the side panel not hinged to the base panel and hinged to the top panel overlaps and connects to the lip, such that a free edge of the lip is disposed immediately adjacent the top panel, to define a tubular element;

the base panel further including a pair of opposing end panels, each hinged to the base panel and movable from a first operative position to a second operative position;

a plurality of corner locks, each defined by a transverse cut line adjacent the end panels, extending across a longitudinal edge between the adjacent top panel and the side panels, such that each corner lock may be inversely disposed relative to the top and side panels to which the respective corner lock is connected in order to orient each adjacent end panel in the second operative position; and a pair of opposing handles movable from a first operative position for stacking to a second operative position for carrying.

9. The carton as defined in claim 8, wherein the handles include a lock configured as a flap in one of the handles for engaging an aperture defined in the opposing handle.

10. The carton as defined in claim 8, wherein one end panel from the pair of opposing end panels extends from a first end of the base panel and the other end panel from the pair of opposing end panels is defined within the base panel having a hinge line adjacent a second end of the base panel such that the end panels move rotationally in the same direction from the first operative position to the second operative position.

11. The carton as defined in claim 8, wherein one end panel from the pair of opposing end panels extends from a first end of the base panel and the other end panel from the pair of opposing end panels extends from a second end of the base panel, such that the end panels move rotationally in opposite directions from the first operative position to the second operative position.

12. The carton as defined in claim 8, wherein the lip further includes a recessed portion in registration with an opening defined when the handles are disposed in the second operative position.

13. A container for foodstuffs comprising:

a carton formed from a cut and creased blank of foldable sheet material, which carton comprises, in set-up condition, a base panel hinged at opposed longitudinal edges to a lip and one of a pair of opposing side panels which flank a top panel such that the side panel not hinged to the base panel and hinged to the top panel overlaps and connects to the lip, such that a free edge of the lip is disposed immediately adjacent the top panel, to define a tubular element;

the base panel further including a pair of opposing end panels, each hinged to the base panel and movable from a first operative position to a second operative position;

a plurality of corner locks, wherein each corner lock is defined by a transverse cut line adjacent to the location of the end panels extending across a longitudinal edge between the adjacent top and side panels, such that each corner lock may be inversely disposed relative to the top and side panels to which the respective corner lock is connected in order to orient the adjacent end panel to the corner lock in the second operative position; and a pair of opposing handles movable from a first operative position for stacking to a second operative position for carrying; and a pad formed from a cut and creased blank of foldable sheet material including a second base panel and opposing pad end panels each hinged to the second base panel at longitudinally spaced lateral edges.

14. The container as defined in claim 13, that further comprises a tray, wherein the carton, the tray and the pad are transversely bisected by a segmented cut line normal to each longitudinal edge such that the container may be separated into like first and second containers.

15. The container as defined in claim 14, wherein the first and second containers each include one end panel from the pair of opposing end panels extending from a first end of the base panel and the other end panel from the pair of opposing end panels is defined within the base panel having a hinge line adjacent a second end of the base panel such that the end panels move rotationally in the same direction from the first operative position to the second operative position.

16. The container as defined in claim 14, wherein the lip further includes a recessed portion in registration with an opening defined when the handles are disposed in the second operative position.

* * * * *